United States Patent [19]

Farmont

[11] 4,429,500

[45] Feb. 7, 1984

[54] BUILDING LOGS WITH WEATHERTIGHT JOINTS

[76] Inventor: Johann H. Farmont, 433 Golden Gate Ave., Belvedere, Calif. 94920

[21] Appl. No.: 195,949

[22] Filed: Oct. 10, 1980

[51] Int. Cl.[3] ..... E04B 1/10

[52] U.S. Cl. ..... 52/233; 46/20; 411/458; 411/461

[58] Field of Search ..... 52/233; 411/458, 461, 411/460, 459, 457; 46/20

[56] References Cited

U.S. PATENT DOCUMENTS

| | | | |
|---|---|---|---|
| 605,978 | 6/1898 | Shepherd | 411/459 |
| 692,909 | 2/1902 | Roberts | 52/DIG. 6 |
| 3,473,277 | 10/1969 | Straight | 52/233 |
| 4,274,241 | 1/1981 | Lindal | 411/461 |

FOREIGN PATENT DOCUMENTS

| | | | |
|---|---|---|---|
| 520454 | 12/1952 | Canada | 52/233 |
| 677042 | 8/1952 | United Kingdom | 52/233 |
| 1172972 | 12/1969 | United Kingdom | 52/233 |
| 1180687 | 2/1970 | United Kingdom | 411/458 |
| 1338575 | 11/1973 | United Kingdom | 52/233 |

OTHER PUBLICATIONS

American Builder, p. 94 from Dec. 1947.

*Primary Examiner*—Henry E. Raduazo
*Attorney, Agent, or Firm*—Melvin R. Stidham

[57] ABSTRACT

A building log comprising a length of timer with essentially planar top and bottom surface interrupted by a pair of parallel tongues running along and near the edges of the top surface, and a complementary pair of grooves running along the bottom surfaces so that stacked logs are interlocked. A segment adjacent the end of the log is cut away at top, and bottom and both sides to a reduced cross-section, so that similarly reduced sections of cross loop may be received in nested relationship. The cuts to the reduced cross section on each sides is at a 45° angle.

3 Claims, 5 Drawing Figures

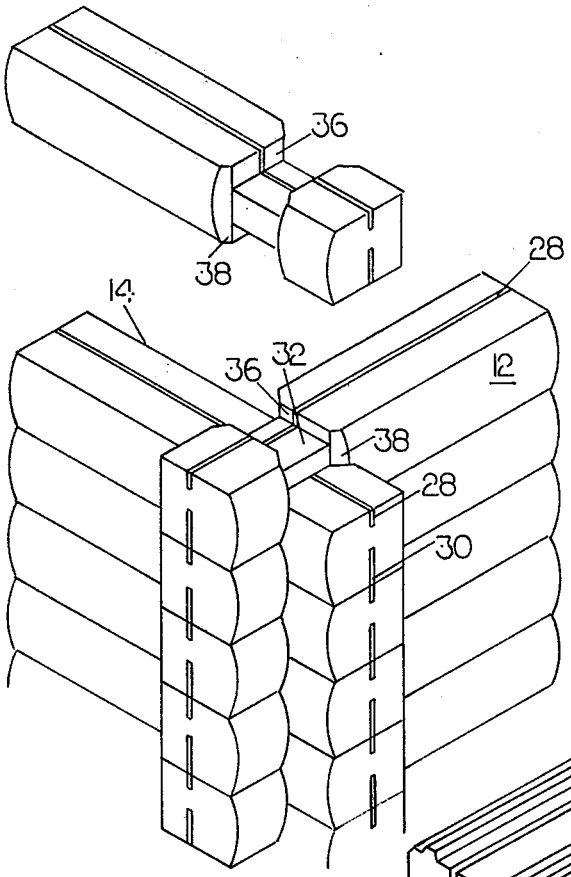
FIG 3
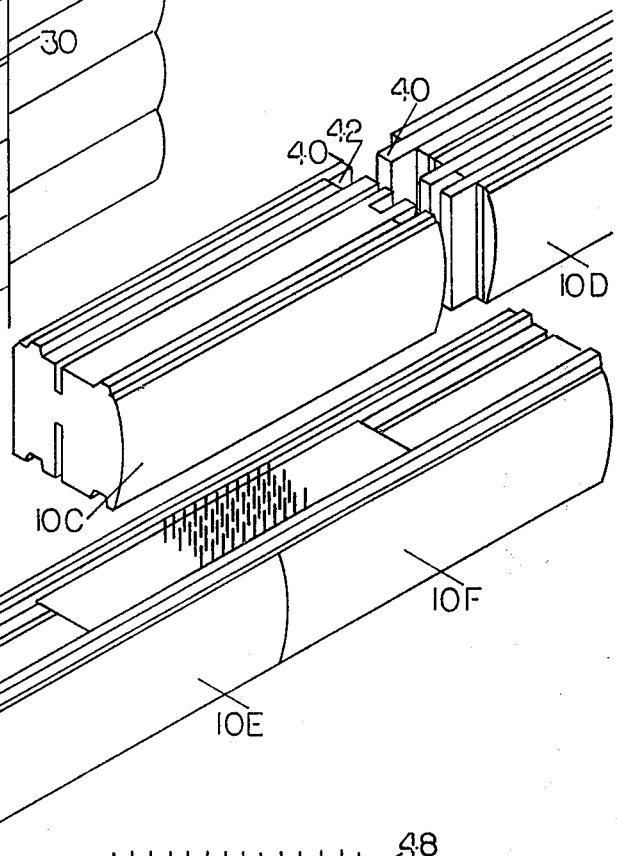
FIG 4
FIG 5
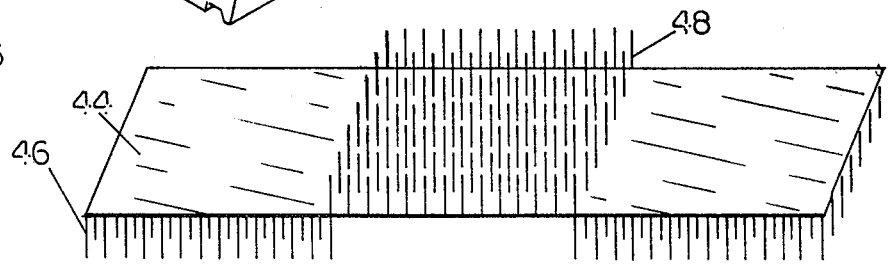

BUILDING LOGS WITH WEATHERTIGHT JOINTS

BACKGROUND OF THE INVENTION

Man has constructed and lived in log cabins and houses over the centuries. The timbers have excellent insulation qualities but the problems of sealing the joints between the logs to render them weatherproof has not been solved completely.

OBJECTS OF THE INVENTION

It is an object of this invention to provide building logs which prevent entry of wind and water between stacked logs.

It is a further object of this invention to provide building logs which may be assembled to prevent intrusion of wind and water at joints between intersecting logs.

It is a further object of this invention to provide building logs which may be easily assembled to provide an attractive wood structure which has high weatherproof characteristics.

Other objects and advantages of this invention will become apparent from the description to follow, particularly when read in conjunction with the accompanying drawings.

SUMMARY OF THE INVENTION

In carrying out this invention, I provide logs which are essentially square in cross section, but which may have a rounded outer surface to similate conventional circular logs. Top and bottom surfaces are planar except for a pair of parallel tongues which run along the length of the log adjacent its edges. Similarly complementary grooves run along the length of the bottom surface so that the logs will stack very easily with planar surfaces engaged and the tongues nested in grooves in interlocking relationship. At an end, the logs are cut away on all four sides to a reduced cross section in which like segments of logs disposed normal to it may be nested. The cut from the inside and outside surfaces are at 45° angles so that when another log is nested therein there is no straight leak path from outside to inside.

BRIEF DESCRIPTION OF THE DRAWINGS

In the drawings:

FIG. 3 is a schematic view in perspective showing formation of a corner of a log structure;

FIG. 4 is a view in perspective showing an end to end log joint;

FIG. 5 is a view in perspective of a fastening device for end to end joints.

DESCRIPTION OF A PREFERRED EMBODIMENT

Figure 1:
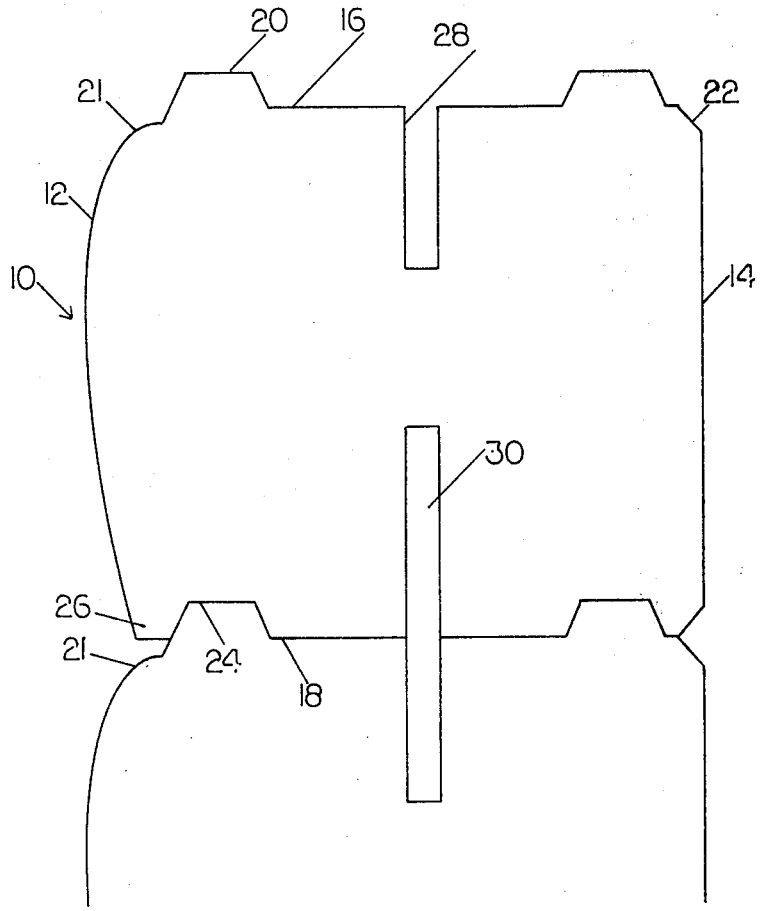
FIG. 1 is section view of a pair of logs formed in accordance with this invention.

Referring now to FIG. 1 with greater particularity, the log 10 of this invention may be basically square in cross section, although it may have a rounded outer surface 12 to create the outward appearance of a conventional circular log. The inner surface may be generally flat as shown, and the top and bottom surfaces 16 and 18 are essentially planar so that one may be stacked on the other with substantial stability.

Protruding from the planar upper surface 16 is a pair of parallel ridges or tongues 20 which run close to, but slightly spaced from the edges 21 and 22 of the top surface. A complementary pair of grooves 24 is formed in the bottom surface 18 so that when the logs are stacked, they have an interlocking relationship which provides a very stable structure just by reason of the weight of the logs, greatly minimizing the requirement for nailing.

Because the tongues 20 are spaced slightly from the edge 21 of the top surface 16, the corresponding spacing of the grooves 24 provides a depending shield or drip lap 26 which prevents any water which may drip down the surface 12 from entering into this seam between the bottom surface 18 and the top surface 16 of the log beneath. In addition, the tongue and groove configuration 20, 24 precludes the possibility of a direct path for wind or rain from outside to the interior.

Expansion slits 28 and 30 are cut into the top and bottom surfaces 16 and 18 to extend well down into the log 10 to absorb any expansion or contraction in the wood in order to prevent unsightly cracking or splitting.

Figure 2:
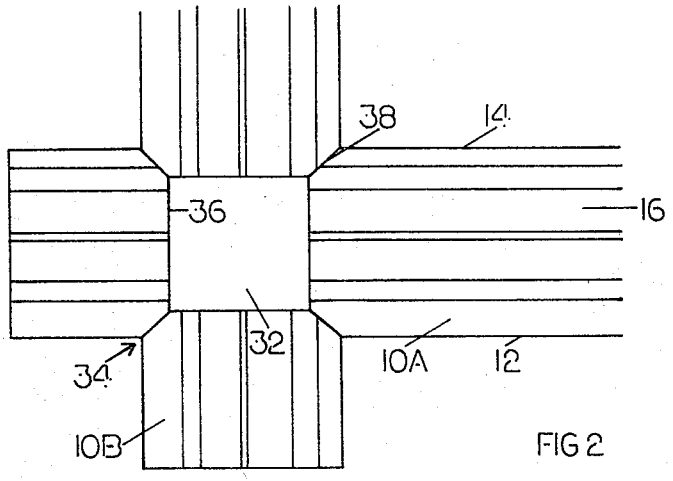
FIG. 2 is a top view of a pair of transversely arranged logs at a corner joint.

Adjacent an end of at least certain logs **10*a* and 10*b* (FIG. 2) the logs are cut away on all sides to a reduced cross-section 32 whereby logs stacked at a corner joint 34 may nest into each other. In forming the reduced cross section 32, the top and bottom surfaces 16 and 18 are cut along vertical lines 36. However, in the side walls 12 and 14 the cuts are along 45° angles 38** so that adjacent logs are wedged in together for a more stable structure and, in addition, to insure that there is no straight line leak path from outside to inside.

Referring now to FIGS. 4 and 5, adjacent logs **10*c* and 10*d* may be provided with fingers 40 and intermediate slots 42 to accommodate complementary fingers 40 in adjacent logs. Hence, logs may be joined end to end in a rigid joint with no straight leak path between them. Then, a nailing plate 44 having a cluster of nails 46 depending therefrom at the opposite ends and a third cluster 48 extending upward, may be driven into an end to end pair of logs 10*e* and 10*f*. Another log 10*c* may then be driven down on the upstanding nails 48 to add rigidity to the structure by tying all three logs together. The log 10*c* is similarly adapted to receive an end to end log 10*d* and be secured by a nailing plate 41**.

While this invention has been described in conjunction with a preferred embodiment thereof, it is obvious that modifications and changes therein may be made to those skilled in the art to which it pertains without departing from the spirit and scope of this invention, as defined by the claims appended hereto.

What is claimed is:

1. A building log comprising:

a length of timber having outer and inner side surfaces, and generally planar top and bottom surfaces;

a segment of said length adjacent one end thereof being cut in at top and bottom and both sides to a reduced cross section adapted to receive at top and bottom, like segments of other timbers disposed normal thereto;

transition surfaces between both side surfaces and said reduced cross-section disposed at 45° to said side surfaces;

a pair of parallel, tapered tongues along one of said planar surfaces and a pair of complementary tapered grooves along the other of said planar surfaces;

fingers extending from an end of said length with spaces therebetween adapted to receive like fingers extending from an adjacent length;

a metal plate having a plurality of pointed projections depending from the bottom surface thereof in areas adjacent both ends thereof only leaving the top surface of said metal plate in said end areas unobstructed for driving said pointed projections into said timber length and said adjacent length; and a further plurality of pointed projections extending upward from said metal plate intermediate said end areas thereof to penetrate the bottom surface of a log supported thereon.

2. The building log defined by claim 1 including:

an expansion slit cut into at least one of said planar surfaces to extend along the length thereof.

3. The building log defined by claim 1 including:

an expansion slit cut into each of said planar surfaces to extend along the length thereof.

* * * * *